US005899033A

United States Patent [19]

Merchlewitz

[11] Patent Number: 5,899,033

[45] Date of Patent: May 4, 1999

[54] ADJUSTABLE HUB ASSEMBLY FOR WINDOW MUNTINS

[75] Inventor: Anthony W. Merchlewitz, Fairbault, Minn.

[73] Assignee: Lake Country Sales, Inc., Elysian, Minn.

[21] Appl. No.: 09/016,132

[22] Filed: Jan. 30, 1998

[51] Int. Cl.[6] ..... E06B 3/964

[52] U.S. Cl. ..... 52/204.61; 52/314; 52/456; 52/656.8; 52/734.2; 52/507; 52/665; 403/218; 403/174

[58] Field of Search ..... 52/204.5, 204.61, 52/456, 314, 507, 656.8, 656.9, 664, 665, 85, 730.1, 730.5, 734.2; 403/217, 218, 219, 174, 178, 113, 119, 161

[56] References Cited

U.S. PATENT DOCUMENTS

| | | |
|---|---|---|
| D. 350,064 | 8/1994 | Crawley . |
| 3,105,274 | 10/1963 | Armstrong . |
| 3,504,468 | 4/1970 | Martin . |
| 4,513,546 | 4/1985 | Gow . |
| 4,530,195 | 7/1985 | Leopold . |
| 4,546,723 | 10/1985 | Leopold et al. . |
| 4,628,582 | 12/1986 | Leopold . |
| 4,783,938 | 11/1988 | Palmer . |
| 4,838,001 | 6/1989 | Battles . |
| 4,949,521 | 8/1990 | Riegelman et al. . |
| 4,970,840 | 11/1990 | Ouellette et al. . |
| 4,989,384 | 2/1991 | Kinghorn et al. . |
| 5,099,626 | 3/1992 | Seeger . |
| 5,154,034 | 10/1992 | Stanek . |
| 5,177,920 | 1/1993 | Rafeld . |
| 5,274,976 | 1/1994 | Burkhart . |
| 5,456,048 | 10/1995 | White . |
| 5,657,590 | 8/1997 | Digman et al. ..... 52/204.61 |
| 5,678,376 | 10/1997 | Poma ..... 52/656.8 |
| 5,678,377 | 10/1997 | Leopold . |

FOREIGN PATENT DOCUMENTS

| | | |
|---|---|---|
| 2506298 | 8/1976 | Germany . |
| 2637034 | 2/1978 | Germany . |
| 88 056 53 U | 8/1988 | Germany . |
| 2106580 | 4/1983 | United Kingdom . |

OTHER PUBLICATIONS

Allmetal, Bulletin CC–90, One Pierce Place, Suite 900, Itasca, Illinois 60143, 1990.

*Primary Examiner*—Christopher Kent
*Assistant Examiner*—Yvonne Horton-Richardson
*Attorney, Agent, or Firm*—Alan Kamrath; Peterson Wicks Nemer & Kamrath, P.A

[57] ABSTRACT

A hub assembly (10) for use in arranging muntins (22) across a window pane includes at least first and second covers (12, 14) which are snap-fit and frictionally held together and which define at least one arcuate track (70) that is adapted to slidably receive carrier members (20) for interconnecting the muntins (22) to the hub assembly (10). The arcuate track (70) coacts with the carrier members (20) to retain the carrier members (20) in selective angular positions about the hub assembly (10). The hub assembly (10), which is semi-circular in plan view, can be selectively attached directly to a window frame, or to another similarly constructed hub assembly (10) to form a circular overall hub assembly.

20 Claims, 2 Drawing Sheets

ADJUSTABLE HUB ASSEMBLY FOR WINDOW MUNTINS

BACKGROUND OF THE INVENTION

1. Field of the Invention

The present invention pertains to the art of windows and, more particularly, to an adjustable hub assembly for use in adjustably mounting muntins across a window pane.

2. Discussion of the Prior Art

Window arrangements commonly found in the construction industry are generally formed from one or more panes of glass mounted in a fixed frame or window sash. When more than one pane of glass is utilized, the panes are generally spaced a certain distance to enhance the thermal insulation properties of the window. For instance, it is common to both evacuate the zone between the panes of glass or fill the zone with an inert gas to increase the R-value of the overall window arrangement.

Regardless of whether a single or multiple panes of glass are utilized, it is sometimes desired to make the window appear as if constructed of a plurality of panes mounted next to one another. Obviously, utilizing a plurality of panes in this manner would achieve this effect. However, it has become much more commonplace to incorporate the use of a window grid that is mounted adjacent a pane of glass or between two panes to provide the appearance of a sectional window arrangement. Known window grid arrangements are typically pre-formed into a predetermined lattice arrangement including strips installed adjacent a window pane with the ends of the various lattice strips being attached to the window frame or sash. These types of arrangements can be very economical to produce and can be individually manufactured for varying size windows, including those exhibiting square, rectangular and arcuate configurations. However, such known arrangements suffer from the drawback that the lattice strips are arranged at predetermined, fixed angles that cannot be adjusted.

It is also known to form a window grid by providing a central hub to which are attached individual muntins that function to make the window appear as if formed from a plurality of panes in a manner directly corresponding to the lattice strips as described above. With such an arrangement, the hub is formed separate from the muntins and incorporates carrier members that are adapted to slidably receive the muntins which are sized depending upon the particular application. Typically, these carrier members are either formed integral with the hub or secured in a stationary position such that the manner in which the window appears to be divided is predetermined by the design of the hub selected for use. For example, when utilized in connection with a semi-circular window, the carrier members are typically arranged at 30° or 45° increments. The main drawback of such an arrangement is in its versatility, i.e., only a single window appearance can be achieved with any given hub design and therefore at least a reasonable number of differently configured hubs must be produced to vary window aesthetics.

In an attempt to address this known problem, it has been proposed in the art to provide a muntin hub that includes a plurality of carrier members, with at least one of the carrier members being rotatable about an axis so as to enable relative angular positioning of the carrier members and, commensurately, the window muntins. Although these proposed arrangements represent some additional versatility, the number of carrier members utilized is limited by the permissible thickness of the overall hub. Typically, only two relatively movable carrier members are provided on a single hub. Therefore, in order to maintain symmetry of the overall muntin arrangement, the ability to actually vary the manner in which the window appears to be divided into multiple panes is also limited. Furthermore, these known arrangements are specifically adapted for use in particular types of windows, with either the hubs being mandatorily positioned within the confines of the window frame or directly secured to the frame.

Based on the above, there exists a need in the art for a hub assembly for window muntins that can provide greater versatility in the number and positioning of muntin carrier members associated therewith, as well as the types of window styles to which the hub assembly can be applied.

SUMMARY OF THE INVENTION

The present invention solves these and other deficiencies and problems in the art by providing an adjustable hub assembly for window muntins which accommodates a varying number of carrier members that can be shifted relative to one another. More particularly, the hub assembly includes an arcuate, track defining portion which slidably receives the carrier members such that the number of carrier members utilized can be readily varied, as well as the relative angular positioning of the carrier members.

In a preferred form of the invention, the hub is formed by interconnecting two, identically constructed, semi-circular covers that are snap-fit together in order to define the arcuate track that is open at comer portions of the hub. An inner rail associated with a respective one of the carrier members can be readily positioned within the track and guidably shifted along the track into a desired position. A detent arrangement is preferably arranged between the track and the inner rail in order to index the carrier members in predetermined angular increments, such as five degree increments, along the track and to aid in retaining the carrier member in a desired position. Each of the carrier members further includes a barbed section about which a respective muntin bar is to be placed.

The hub assembly can be utilized to cosmetically divide a semi-circular or even polygon-shaped window pane into various sections by centrally anchoring a straight side of the hub to a frame of the window, arranging a desired number of muntin carrier members about the arcuate portion of the hub and then positioning a corresponding number of muntins between the hub and the frame of the window. The versatile hub assembly of the invention can also be used in dividing circular and polygon-shaped window panes by interconnecting the straight sides of two similarly constructed, muntin carrying hub assemblies such that a circular carrier track is formed. In this case, the combined hub assembly would be located in the center of the circular window and the muntins would radiate outwardly therefrom.

It is thus an object of the present invention to provide a hub assembly for window muntins wherein the hub assembly can include a varying number of muntin carrier members about an arcuate portion thereof.

It is another object of the present invention to provide a hub assembly that accommodates shifting of the carrier members in order to enable selective angling of the carrier members about the arcuate portion.

It is a further object of the present invention to provide a versatile hub assembly that can be readily manufactured with a minimum number of parts, yet can be used to cosmetically divide window panes of various geometric shapes.

Additional objects, features and advantages of the adjustable hub assembly of the present invention will become more readily apparent from the following detailed description of the preferred embodiment thereof when taken in conjunction with the drawings wherein like reference numerals refer to corresponding parts in the several views.

Figure 1:
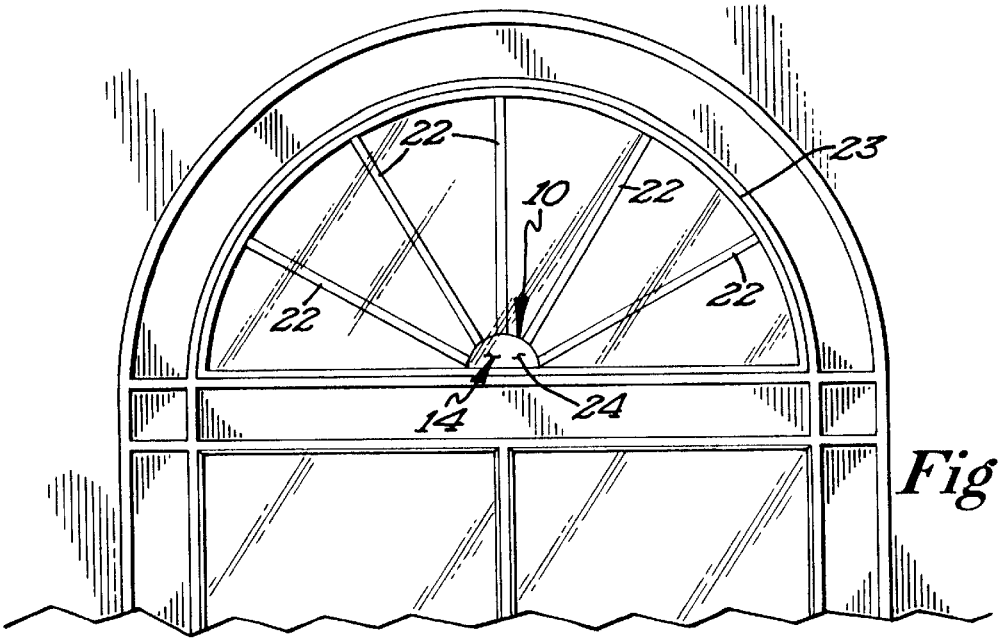
FIG. 1 is a front plan view of a window arrangement incorporating the adjustable hub assembly of the present invention.

At this point, it should be noted that all of the figures are drawn for ease of explanation of the basic teachings of the present invention only; extension of the figures with respect to the number, position, relationship and dimension of the parts to form the preferred embodiment will be within the skill of the art after the following teachings of the present invention have been read and understood. Further, the exact dimensions and dimensional proportions to conform to specific force, weight, strength and similar requirements will likewise be within the skill of the art after the following teachings of the present invention have been read and understood.

Furthermore, when the terms "top", "bottom", "first", "second", "lower", "upper", "inner", "outer", "upwardly", "downwardly", "vertical", "horizontal", "right", "left", and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

An adjustable hub assembly for window muntins according to the preferred teachings of the present invention is shown in the drawings and designated 10. Hub assembly 10 generally includes first and second, interconnected covers 12 and 14 that form a central hub, as well as a selected number of muntin carrier members 20. In general, the carrier members 20 project outwardly, at selected locations, fiom the central hub and are used to interconnect various muntins 22 to the hub, with the muntins 22 projecting across a pane of glass to a frame 23 associated with the window in a manner illustrated in FIG. 1. In this figure, a semi-circular window is illustrated for exemplary purposes but, as will become fully evident after the description of the preferred embodiment of the present invention has been read and understood, adjustable hub assembly 10 can be utilized as part of a grid assembly for dividing windows of various geometric shapes.

In accordance with the preferred form of the invention, each of the covers 12 and 14 is identically constructed. Therefore the construction of cover 12 will now be fully described, and it is to be understood that cover 14 has corresponding structure. Cover 12 includes an outer surface 24 which is to be exposed through the pane-of glass during use of the adjustable hub assembly 10 and an inner surface 26. As clearly shown, cover 12 is semi-circular in plan view. Projecting from inner surface 26 is an arcuate track defining base 28 which has associated therewith a track side wall 30 that is generally constituted by a reduced thickness extension of inner surface 26. Extending from side wall 30 in an arcuate plane generally parallel to but spaced from base 28 is an arcuate projection 34. As clearly shown in FIGS. 3 and 4, arcuate projection 34 projects from side wall 30 a distance less than base 28. Preferably, base 28 is formed with a plurality of circumferentially spaced nubs 36. Although the number and arrangement of nubs 36 can vary in accordance with the present invention, in the most preferred form, the hub assembly 10 has nubs 36 arranged at 5 degree increments about the circumference of base 28.

Figure 3:
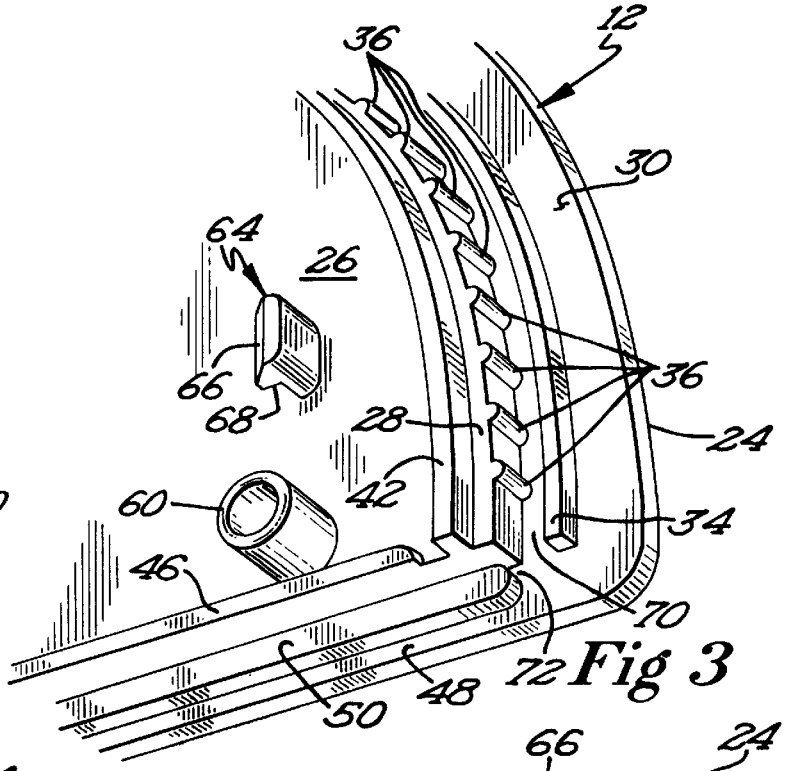
FIG. 3 is an enlarged view of a comer portion of a cover member that forms part of the hub assembly.
Figure 4:
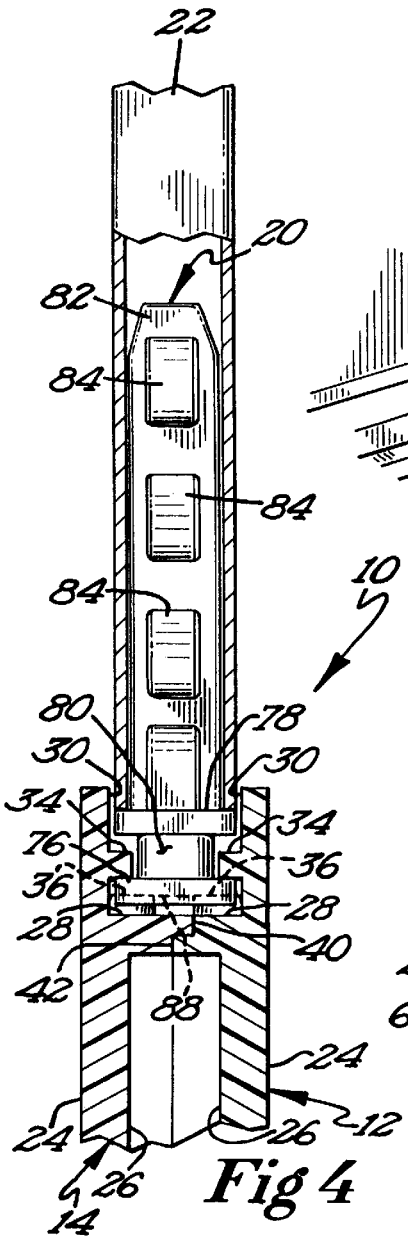
FIG. 4 is a cross-sectional view generally taken along line 4—4 in FIG. 2.

Extending along base 28 and projecting further from inner surface 26 are a pair of offset arcuate ridges 40 and 42. More specifically, arcuate ridge 40 generally has an outer surface that is an extension of an upper surface of base 28 and an inner surface that has an associated radius substantially equal to a radius associated with the outer surface of the ridge 42. Meanwhile, ridge 42 has an inner surface that generally constitutes an extension of a lower surface of base 28. Also projecting from inner surface 26 is a straight lower base 46 that interconnects terminal end portions of track defining base 28. Inner surface 26 also defines a wall portion 48 associated with lower base 46, with wall portion 48 having an associated thickness preferably equal to that of side wall 30. A linear projection 50 extends from wall portion 48 a distance preferably equal to the distance of arcuate projection 34 from side wall 30, while being somewhat thicker as best shown in FIG. 3. Located intermediate the ends of lower base 46 is a retainer tab 52.

Figure 2:
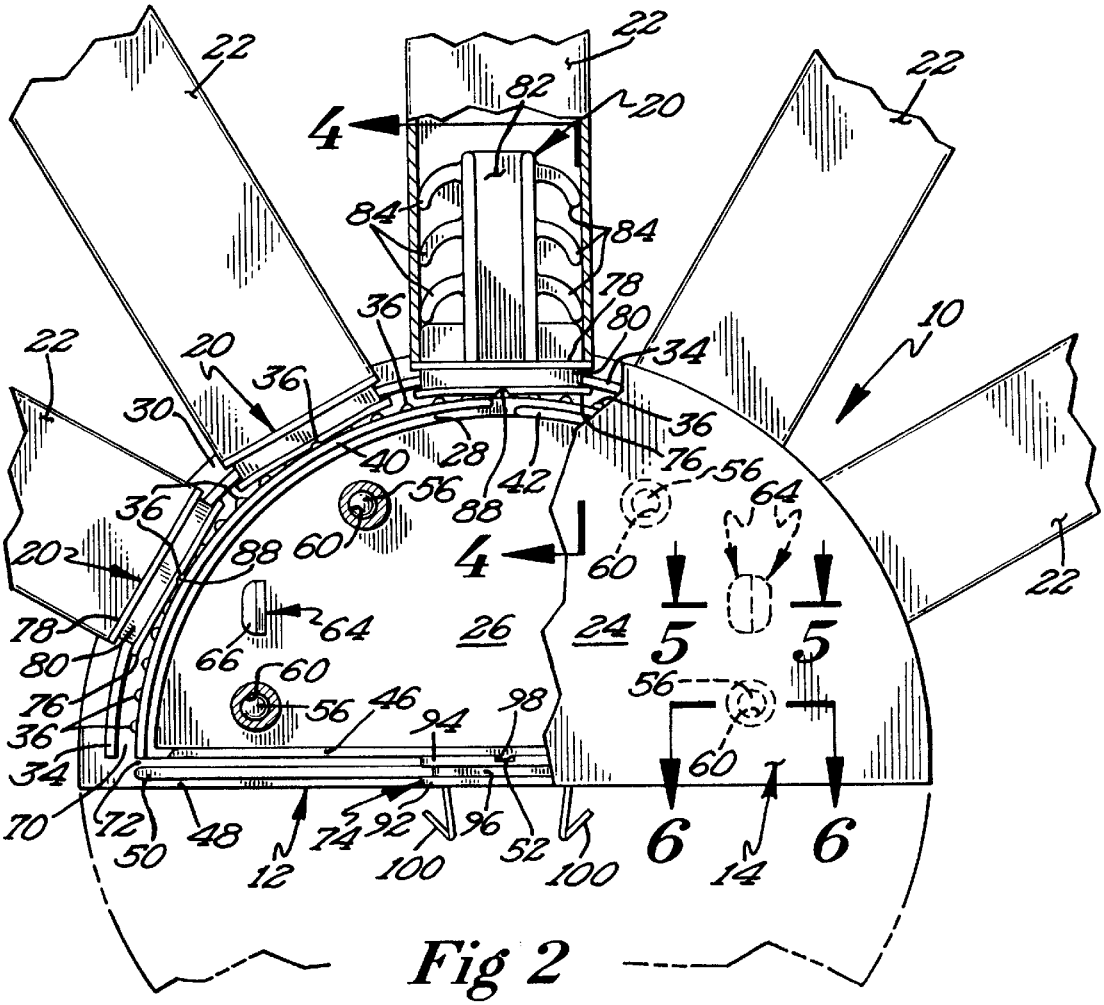
FIG. 2 is an enlarged, partial cut-away view of the hub assembly shown in FIG. 1.

As also clearly shown in these figures, inner surface 26 is provided with one or more upstanding pins 56, as well as a corresponding number of pin receptacles 60. As best shown in FIG. 2, receptacles 60 are arranged on inner surface 26 at symmetrical locations from a center line of cover 12 with respect to pins 56. In the most preferred form, pins 56 are provided to the left of the center line and both receptacles 60 are to the right. In addition, a pair of spaced mounting clips 64 are symmetrically provided about a center line of cover 12, with each of the mounting clips 64 including a tapered surface 66 leading to an undercut 68. In the preferred form of the invention, both of the mounting clips 64 are arranged with the tapered surfaces 66 and undercuts 68 facing a common direction which is best illustrated in FIG. 3.

Figure 5:
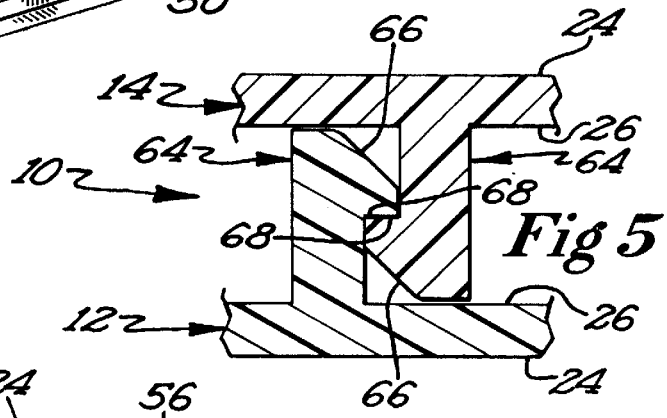
FIG. 5 is a cross-sectional view generally taken along line 5—5 in FIG. 2.
Figure 6:
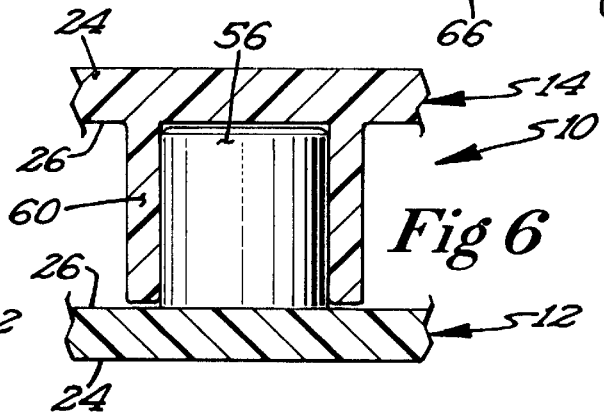
FIG. 6 is a cross-sectional view generally taken along line 6—6 in FIG. 2.

With each of covers 12 and 14 taking the preferred construction described above, the covers 12 and 14 can be snap-fit connected to one another with respective mounting clip 64 becoming interengaged in the manner shown in FIG. 5 and with pins 56 being frictionally received within respective receptacles 60 as best shown in FIG. 6. In addition, the offset arcuate ridges 40 and 42 of each of the covers 12 and 14 aid in properly aligning each of the bases 28 and 46 of covers 12 and 14. This is perhaps best represented by the manner in which the bases 28 of covers 12 and 14 are arranged in the assembled state of FIG. 4. As clearly shown in this figure, joining of covers 12 and 14 defines an arcuate carrier track 70 that is adapted to receive carrier members 20. In a similar manner, the lower bases 46 of covers 12 and 14 form a linear track 72 that is adapted to receive a hub connector or anchor 74, the construction and arrangement of which will be detailed below, used to secure hub assembly 10 to the window frame 23 or to another similarly constructed hub assembly 10 to form a combined circular hub assembly.

In the preferred embodiment shown, each of the carrier members 20 includes a lower rail 76 and an upper rail 78 that are joined by a connector portion 80. Each carrier member 20 also includes an upstanding pin portion 82 provided with a plurality of outward extending barbs 84. With this construction, each of the carrier members 20 can be initially received within arcuate carrier track 70 at one of the two lower comers of the hub assembly 10, with lower rails 76 of each carrier member 20 being positioned between each base 28 and the arcuate projections 34 of covers 12 and 14. At the same time, connector portion 80 extends through a gap defined between the arcuate projections 34 of the covers 12 and 14, and upper rail 78 is simply positioned between the side walls 30. In the most preferred form, upper rail 78 is recessed within track 70 such that, when a muntin 22 is positioned about upstanding pin portion 82 and frictionally retained thereon by the presence of barbs 84, both upper rail 78 and the terminal end of the muntin 22 will be arranged below the outer periphery of covers 12 and 14 as clearly shown in FIGS. 2 and 4. Therefore, with this arrangement, the terminal end of muntin 22 will not be visible such that a more aesthetically appealing grid arrangement is provided.

The lower surface of lower rail 76 is preferably provided with a central indentation 88 that cooperates with a respective nub 36 to retain the carrier member 20 in a desired position around track defining base 28. Therefore, nubs 36 cooperate with indentations 88 to act as a detent arrangement for the positioning of respective carrier members 20 about the arcuate portion of the hub assembly 10. With the arrangement of nubs 36 at selected angular positions, carrier members 20 can be slidably positioned within arcuate track 70 to enable selective angling of the carrier members 20. Therefore, with this arrangement, the number of carrier members 20 can be varied, as well as the relative angling of the various carrier members 20 about arcuate track 70 by simply sliding the carrier members 20 to desired locations along the track 70 and maintaining the carrier members 20 in the selected positions with the aid of the detent arrangement defined by nubs 36 and indentations 88.

At this point, it should be readily apparent that the particular detent arrangement utilized to aid in positioning carrier members 20 can vary greatly without departing from the spirit of the invention. Therefore, the arrangement of nubs 36 and indentations 88 could be reversed or the carrier members 20 could coact with another portion of arcuate track 70, such as side walls 30, to perform this identical function without departing from the spirit of the invention. In addition, the particular structure and arrangement of pins 56, receptacles 60 and mounting clips 64 could also vary without departing from the spirit of the invention. The preferred construction is presented since it has been found to enable easy assembly of covers 12 and 14 while providing for a secure interconnection between covers 12 and 14 through the snap-fit of the mounting clips 64, the frictional engagement between the pins 56 and receptacles 60, and the arrangement of offset arcuate ridges 40 and 42.

While arcuate track 70 is adapted to receive a selected number of carrier members 20, hub assembly 10 also defines the linear track 72 along the base 46 of each of the covers 12 and 14. As mentioned above, this track 72 is adapted to receive connector or anchor 74 for either securing hub assembly 10 to window frame 23 as shown in FIG. 1, preferably in a snap-fit manner, or to another identically constructed hub assembly 10 that is provided with a cooperating connector/anchor, such that the two hub assemblies 10 can be directly interconnected to define, in the most preferred form, a circular hub assembly. With such an arrangement, the carrier members 20 would be initially inserted within a respective one of the arcuate tracks 70 prior to interconnection of the hub assemblies 10 and the overall assembly could be placed in the center of a pane of glass with various muntins 22 projecting outwardly at selected angles through 360°.

Connector or anchor 74 is preferably formed with upper and lower rails 92 and 94 which are interconnected by a connector portion 96 in a manner corresponding to the structure of carrier numbers 20. Connector or anchor 74 is similarly formed with a central indentation 98. More specifically, upper rail 92 includes the central indentation 98 which is adapted to register with retainer tab 52 to properly position connector or anchor 74 in linear track 72. When hub assembly 10 is to be attached to window frame 23, anchor 74 preferably includes a pair of spaced prongs 100 extending from lower rail 94. In the most preferred form of the invention, each prong 100 includes a linear section extending substantially perpendicular from lower rail 94 and an angled return prong section that can deflect when the prong 100 is inserted into a receiving cavity (not shown) associated with window frame 23.

In any event, it should be apparent that the adjustable hub assembly 10 of the present invention can be easily manufactured with a minimum number of parts and can readily provide for the selected positioning of a varying number of carrier members and muntins. In addition, the covers 12 and 14 can be made of the same or varying colors to further enhance the overall appearance thereof. In the most preferred form, each of the covers 12 and 14, as well as the carrier members 20, are molded of plastic. Of course, the particular type of carrier member 20 utilized can also vary greatly without departing from the spirit of the invention. For instance, the carrier members could be constructed to be slidably received about a track that takes the form of a rail having undercut outer walls within the scope of the invention.

Now that the basic teachings of the adjustable hub assembly 10 according to the present invention have been set forth, it should be apparent that other variations will be obvious to persons skilled in the art. Thus, the invention disclosed herein may be embodied in other specific forms without departing from the spirit or general characteristics thereof, some of which forms have been indicated, and the embodiment described herein should be considered in all respects illustrative and not restrictive. The scope of the invention is to be indicated by the appended claims rather than by the foregoing description, and all changes which come within the meaning and range of equivalents of the claims are intended to be embraced therein.

I claim:

1. A hub assembly for adjustably interconnecting a plurality of muntin bars along a window pane comprising, in combination: a hub including a track defining portion; and a plurality of carrier members for interconnecting muntin bars to the hub, with the carrier members being slidable along the track defining portion of the hub to enable selective positioning of the carrier members along the track defining portion.

2. The hub assembly according to claim 1 wherein each carrier member includes a hub connecting portion slidably attached to the track defining portion and a muntin bar connecting portion projecting from the hub.

3. The hub assembly according to claim 2 wherein the muntin bar connecting portion is barbed.

4. The hub assembly according to claim 2 wherein the track defining portion further comprises, in combination: a base and a pair of spaced upstanding side walls, with the carrier members being slidably received between the upstanding side walls.

5. The hub assembly according to claim 4 wherein the track defining portion further comprises, in combination: a projection extending from each of the side walls towards an opposing one of the side walls at a position spaced radially from the base, with the hub connecting portion of each of the carrier members including an inner rail adapted to be positioned between the base and the projections.

6. The hub assembly according to claim 5 wherein the hub connecting portion of each of the carrier members further includes an outer rail extending between the side walls on an opposite side of the projections from the inner rail.

7. The hub assembly according to claim 4 further comprising, in combination: detent means acting between the track defining portion and each of the carrier members for selectively retaining the carrier members in desired positions along the track defining portion.

8. The hub assembly according to claim 7 wherein the detent means acts between the base of the track defining portion and the carrier member.

9. The hub assembly according to claim 8 wherein each of the carrier members includes an inner rail adapted to be positioned within the track defining portion and the detent means includes a plurality of upstanding detent elements spaced along the base and at least one recess formed in the inner rail.

10. The hub assembly according to claim 7 wherein the track defining portion of the hub constitutes an arcuate portion.

11. The hub assembly according to claim 10 wherein said detent means selectively retains the carrier members in five degree angular increments about the arcuate portion.

12. The hub assembly according to claim 1 wherein the track defining portion of the hub constitutes an arcuate portion, with the carrier members being slidable along the arcuate portion to enable selective angling of the carrier members about the arcuate portion.

13. The hub assembly according to claim 1 where the hub is formed from first and second interconnected covers.

14. The hub assembly according to claim 13 wherein the first and second covers are identically constructed.

15. The hub assembly according to claim 14 wherein the first and second covers include cooperating sets of snap-fit connectors.

16. The hub assembly according to claim 15 wherein each of the first and second covers further includes at least one pin and at least one receptacle, with the pin of the first cover being adapted to be frictionally fit within the receptacle of the second cover and vise-versa.

17. The hub assembly according to claim 14 wherein each of the first and second covers is formed with offset, non-overlapping arcuate ridges, with the offset ridges of the first cover being adapted to be interengaged with the offset ridges of the second cover.

18. The hub assembly according to claim 14 wherein the track defining portion of the hub constitutes an arcuate portion, with each of the first and second covers being generally semi-circular in shape thereby defining the arcuate portion of the hub and a linear portion.

19. The hub assembly according to claim 18 wherein the linear portion includes a mounting track for slidably receiving a hub connector.

20. The hub assembly according to claim 19 further comprising, in combination: retainer means provided along the mounting track for locating a hub connector in a predetermined position.

* * * * *

UNITED STATES PATENT AND TRADEMARK OFFICE

CERTIFICATE OF CORRECTION

PATENT NO : 5,899,033

DATED : May 4, 1999

INVENTOR(S) : Merchlewitz

It is certified that error appears in the above-identified patent and that said Letters Patent is hereby corrected as shown below:

Col. 2, line 29, delete "comer" and insert - - corner - -

Col. 3, line 15, delete "comer" and insert - - corner - -

Col. 5, line 8, delete "comers" and insert - - corners - -

Signed and Sealed this

Nineteenth Day of October, 1999

*Attest:*

*Attesting Officer*

Q. TODD DICKINSON

*Acting Commissioner of Patents and Trademarks*